US008967831B2

(12) United States Patent
Chien

(10) Patent No.: US 8,967,831 B2
(45) Date of Patent: Mar. 3, 2015

(54) LED BULB, LAMP HOLDER, OR ADAPTOR INCLUDING A MODULE THAT EXTENDS BEYOND A SHADE, COVER, OR OTHER LIGHT BLOCKING ELEMENT TO PERMIT SIGNAL OR LIGHT TRANSMISSION TO OR FROM THE MODULE

(76) Inventor: Tseng-Lu Chien, Walnut, CA (US)

( * ) Notice: Subject to any disclaimer, the term of this patent is extended or adjusted under 35 U.S.C. 154(b) by 0 days.

(21) Appl. No.: 13/367,758

(22) Filed: Feb. 7, 2012

(65) Prior Publication Data

US 2013/0201668 A1 Aug. 8, 2013

Related U.S. Application Data

(63) Continuation-in-part of application No. 13/295,301, filed on Nov. 14, 2011, now Pat. No. 8,760,514, and a continuation-in-part of application No. 13/296,508, filed on Nov. 15, 2011, now Pat. No. 8,562,158, and a continuation-in-part of application No. 13/296,469, filed on Nov. 15, 2011, now Pat. No. 8,711,216.

(51) Int. Cl.

| | |
|---|---|
| ***F21V 23/04*** | (2006.01) |
| ***F21V 33/00*** | (2006.01) |
| ***F21V 19/02*** | (2006.01) |
| ***F21V 21/00*** | (2006.01) |
| ***F21S 4/00*** | (2006.01) |

(52) U.S. Cl.
USPC ..... 362/276; 362/234; 362/253; 362/285; 362/249.02

(58) Field of Classification Search
USPC ..... 362/800, 802, 545, 646–659, 362/249.02–249.06, 234, 253, 276; 340/815.45
See application file for complete search history.

(56) References Cited

U.S. PATENT DOCUMENTS

| | | | | |
|---|---|---|---|---|
| 4,180,850 | A * | 12/1979 | Bivens | 362/285 |
| 4,365,237 | A * | 12/1982 | Knight | 340/521 |
| 5,142,463 | A * | 8/1992 | Panagotacos et al. | 362/285 |
| 7,346,196 | B2 * | 3/2008 | Gin | 382/118 |
| 7,387,403 | B2 * | 6/2008 | Mighetto | 362/218 |
| 7,543,958 | B2 * | 6/2009 | Chi et al. | 362/276 |
| 7,597,455 | B2 * | 10/2009 | Smith et al. | 362/249.01 |
| 7,775,691 | B2 * | 8/2010 | Burgei et al. | 362/386 |
| 7,817,016 | B2 * | 10/2010 | Haase | 340/326 |
| 2005/0185398 | A1 * | 8/2005 | Scannell, Jr. | 362/227 |

* cited by examiner

*Primary Examiner* — Jong-Suk (James) Lee
*Assistant Examiner* — Alexander Garlen
(74) *Attorney, Agent, or Firm* — Bacon & Thomas, PLLC

(57) ABSTRACT

An LED bulb, lamp holder, or adaptor includes a module that extends beyond a shade, cover, or other light blocking element to permit signal or light transmission to or from the module.

11 Claims, 12 Drawing Sheets

62
66
74
62
69
70
68
71

62
68
70
71
69

66
74
62
69
70
68

62
66
74
62
69
70
68
71

62

64
74
60
66

64
74
60
66

64
66
74

64
60
74
66

80
81
82
83
84
84 or 82
85
31

LED BULB, LAMP HOLDER, OR ADAPTOR INCLUDING A MODULE THAT EXTENDS BEYOND A SHADE, COVER, OR OTHER LIGHT BLOCKING ELEMENT TO PERMIT SIGNAL OR LIGHT TRANSMISSION TO OR FROM THE MODULE

This application is a continuation-in-part of U.S. patent application Ser. Nos. 13/295,301, 13/296,508, and Ser. No. 13/296,469, each filed on Nov. 15, 2011.

BACKGROUND OF THE INVENTION

The three copending parent applications are related to the inventor's U.S. patent application Ser. No. 12/951,501 ("Lamp Holder has built in LED Night light"), and current application also has subject matter in common with the inventor's U.S. patent application Ser. No. 12/950,017 ("Multiple surface LED light").

for the following patent applications of the inventor are generally directed to LED lights and disclose structures that may be used in connection with the present invention: U.S. patent application Ser. Nos. 13,296,508, 13/295,301, 13/296,469, 13/162,824, 12/938,628, 12/887,700, 12/149,963 (U.S. Pat. No. 7,722,230), Ser. No. 12/073,095 (U.S. Pat. No. 7,726,869), Ser. Nos. 12/073,889, 12/007,076 (U.S. Pat. No. 7,726,841), Ser. No. 12/003,691 (U.S. Pat. No. 7,726,839), and Ser. No. 12/894,865.

Other prior art includes U.S. patent and Patent Publication Nos. U.S. Pat. No. 7,524,089 (Park), U.S. Pat. No. 6,499,860 (Begemann), U.S. Pat. No. 6,220,722 (Begemann), U.S. Pat. No. 5,924,784 (Chliwnyj et al), 2003/0185020 (Stekelenburg), 2006/0146527 (Vanderschuit), and U.S. Pat. No. 6,648,496 (Elghoroury), Although the listed prior art discloses related subject matter, none of the prior art patents and publications discloses extendable constructions and more than one added function for an LED Bulb, lamp holder, or lamp holder adaptors to enable light beams or electric signals to be transmitted and received over a blocking-means, as described below.

Lamp holders and LED light bulbs that have a variety of functions are currently available in the marketplace. However, none includes both a built-in LED light and lamp holder with any combination of the following functions: (1) motion sensor; (2) remote control (RF); (3) BLUETOOTH® remote control; (4) timer; (5) countdown; (6) seven-day programmable timer; (7) multiple area illumination; and (8) other electrical functions available from the marketplace to cause the LED light means to turn on and off and provide certain functions, duration, color, brightness, focus, and performance using optional parts and accessories.

The current invention preferably incorporates a combination of selected parts and accessories to create light effects in a LED lamp holder LED bulb with extendable bars. The parts and accessories include:

(a) plug parts of the lamp holder or lamp holder adaptor to connect with power source and get power:
(b) multiple parts for providing different illumination area(s);
(c) an extendable piece(s) having different geometric shapes and sizes;
(d) stopper means having a geometric shape and size to stop the extendable piece(s);
(e) energy storage means for DC energy, such as rechargeable or regular batteries;
(f) LED-unit(s) and LED-assembly(s) for desired brightness and size and shape;
(g) circuit means to provide a variety of desired function(s)

(h) conductive means and related parts and accessories for delivery of an electric signal;
(i) construction parts to fit the related mechanical or electric parts & accessories within;
(j) motion sensor means;
(k) remote control means;
(l) BLUETOOTH® remote control means;
(m) timer means;
(n) countdown means;
(o) seven-day programmable timer means;
(p) other switch means or sensor means;
(q) integrated circuit (IC) means;
(r) digital data record and storage means;
(s) optics means including all kinds of lens, stencil, window, opening, cut-outs, reflective lens, retro-reflective lens, opaque lens, condensing lens, convex lens, concave lens, or adjustable focus means lens, or any other optics means that may be applied to an LED light means;
(t) s heat sink to ventilate heat from the LEDs heat to outside the unit;
(u) receiving parts and accessories of a lamp holder or lamp holder adaptor;
(v) body parts that are transparent, translucent, opaque, and/or anti-flammable;
(w) heat isolating means;
(x) light block-out means;
(y) switch means or sensor means available from the marketplace;
(z) linkable means to cause multiple LED lights or lamp holders to illuminate at the same time.

The current invention includes an extendable piece(s) to enable added functions to be provided without interference from the a lamp shade, lamp glass, or lamp cover, which is normally designed to cover an incandescent bulb's ugly shape. The extendable piece(s) are necessary to provide the lamp-holder or LED Bulbs with extra space to install "added functions" without been blocked by the lamp-shade, lamp-glass, lamp cover or any other block-out-the-light means.

The current invention's extendable piece(s) can be positioned at a rear end of a lamp holder or lamp holder adaptor to enable plug parts to get power from a power source, or at a front of a lamp bulb to enable a sensor means, switch means, or RF receiving means to get an electric signal over a lamp shade, lamp cover, lamp glass, etc. that constitute a blocking means for light emitted by the light fixture.

A main feature of the current invention is thus the provision of (1) an LED bulb; (2) lamp holder; or (3) lamp holder adaptor to overcome blocking-means and enable the LED bulb, lamp holder, or lamp holder adaptor to add "Extra Functions" without block out by a lamp shade, lamp cover, lamp glass, or other blocking means.

The current invention further provides an LED bulb which has an extendable piece to allow the LED bulb to overcome the blocking means. The LED bulb may be connected with a lamp holder or lamp holder adaptor to get power for illumination.

The current invention further provides a lamp holder which has an extendable piece to allow the lamp holder to overcome the blocking means, the lamp holder having one end connected with a house electricity system and one end connected with light-source means.

The current invention further provides a lamp holder adaptor which has an extendable piece to allow the lamp holder adaptor to overcome the blocking means and provide added functions within body parts, the lamp holder adaptor having one end connected with an existing lamp holder, and one end connected with a light-source means.

BRIEF DESCRIPTION OF THE DRAWINGS

FIGS. 1-4 to 1-22 show details of an LED bulb, lamp holder, and lamp holder adaptor that may be applied to the embodiments of FIGS. 1-1, 1-2, and 1-3.

FIGS. 2-1 to 2-4 show a length difference when the extendable piece(s) of the preferred embodiments is extended-out versus when the extendable piece(s) is not extended.

FIG. 3-1 shows a lamp holder having an extendable construction on its base that permits addition of other functions.

It is to be appreciated features disclosed in the inventor's related applications, including patent drawings, detailed description and content may be added to the presently disclosed embodiments without departing from the scope of the current invention, and that the invention is not limited to the current drawings, detailed description, and content.

DETAILED DESCRIPTION OF THE PREFERRED EMBODIMENTS

The current invention relates to a device having an LED and an extendable construction that overcomes blocking by a lamp cover, lamp shade, lamp glass, or other blocking means which block out light beams or electric signals from being transmitted therethrough, and enabling more than one function to be provided without interference from the blocking means. The current invention may be in the form of an LED bulb, lamp holder, or lamp holder adaptor(s).

Figures 1, 2, 3, 4:
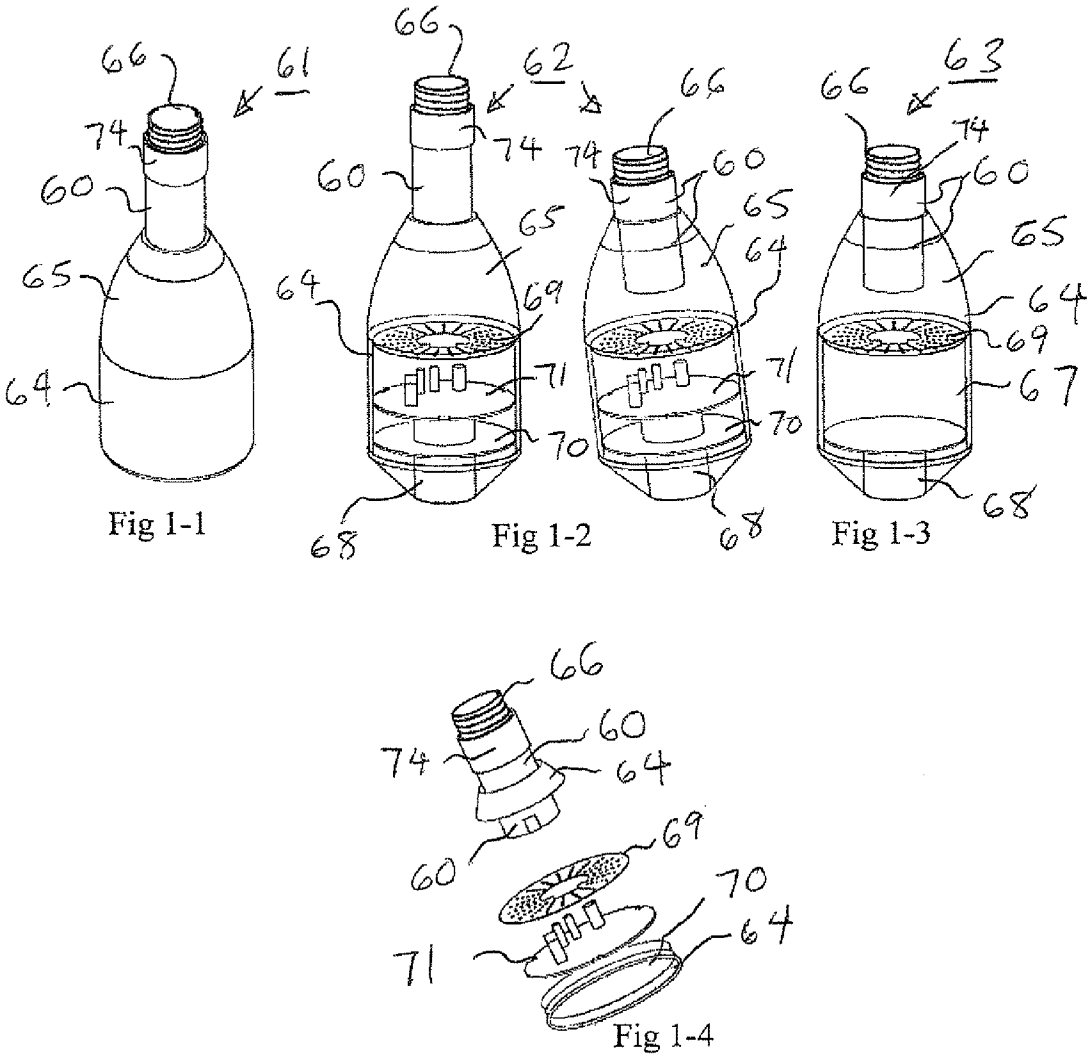
Figures 1, 2, 3, 4, 5, 6, 7:
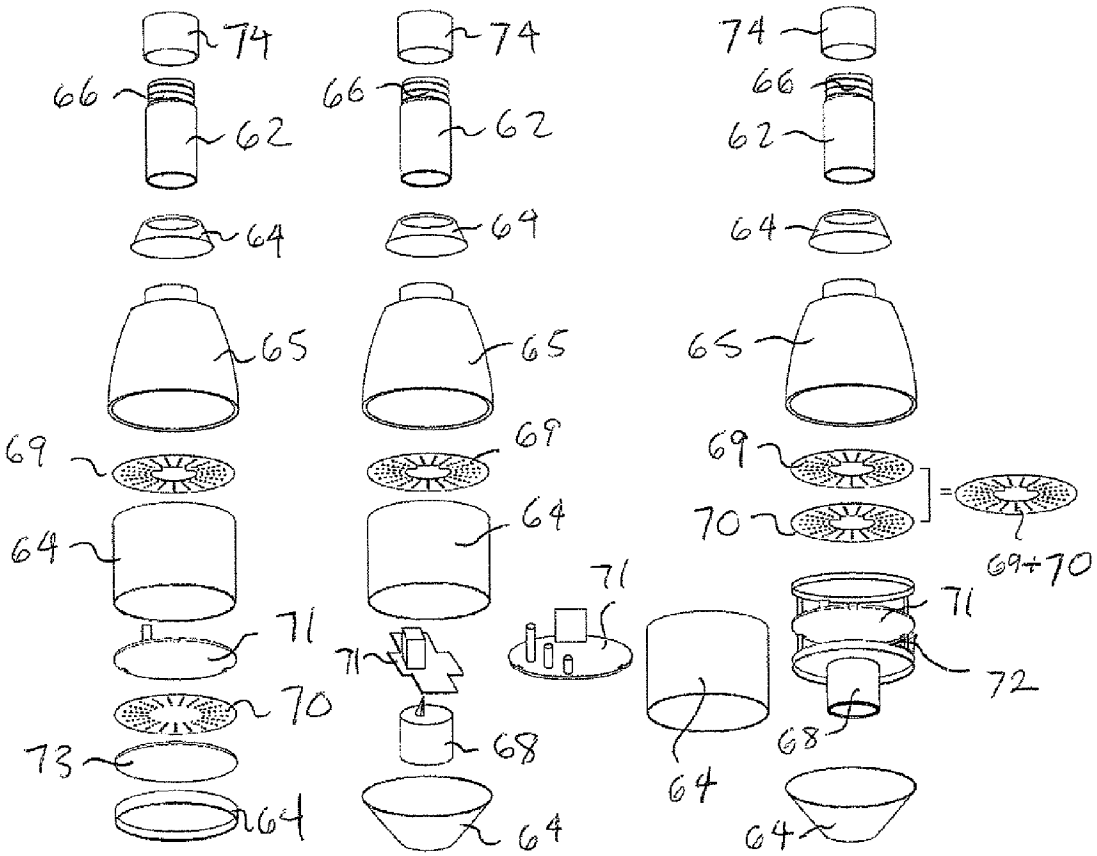
Figures 1, 2, 3, 4, 5, 6, 7, 8, 9, 10, 11:
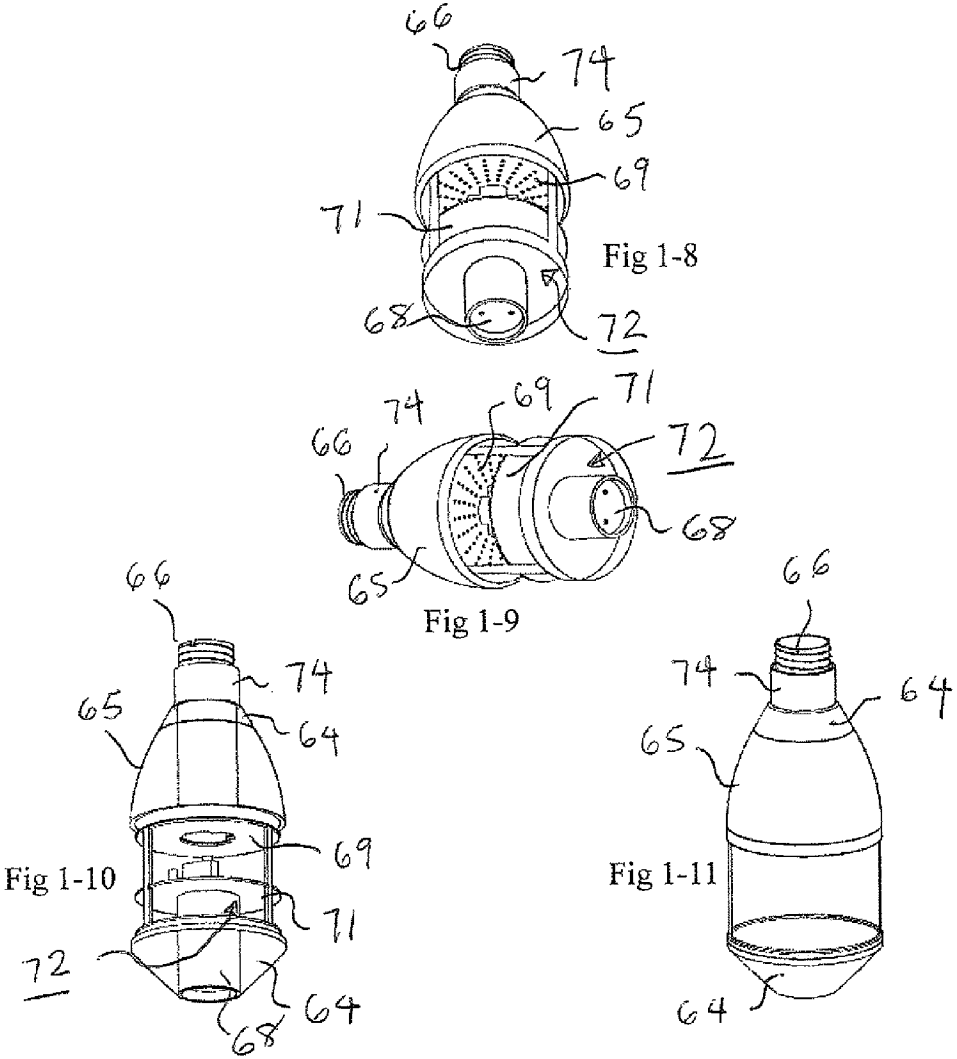
Figures 1, 2, 3, 4, 5, 6, 7, 8, 9, 10, 11, 12, 13, 14, 15:
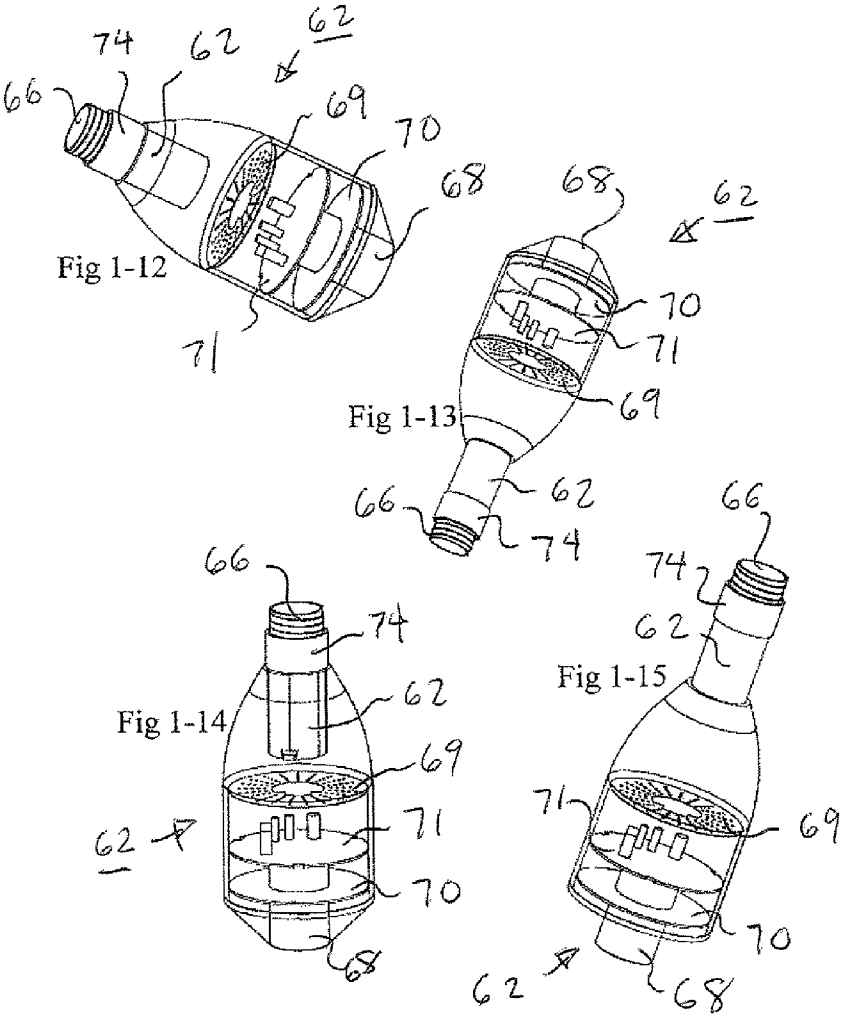
Figures 1, 2, 3, 4, 5, 6, 7, 8, 9, 10, 11, 12, 13, 14, 15, 16, 17:
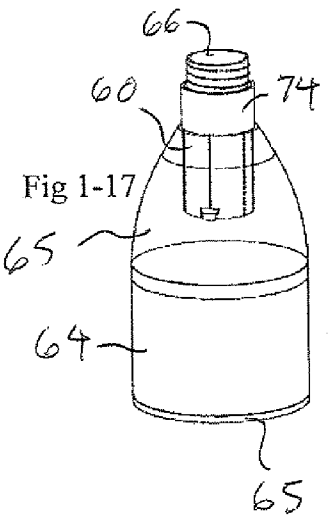
Figures 1, 2, 3, 4, 5, 6, 7, 8, 9, 10, 11, 12, 13, 14, 15, 16:
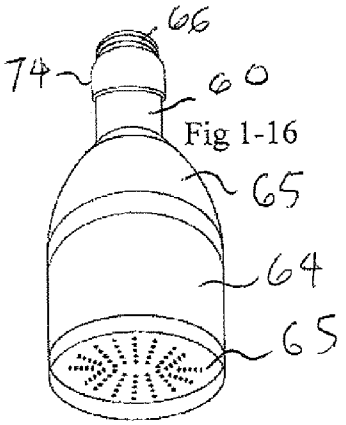
Figures 1, 2, 3, 4, 5, 6, 7, 8, 9, 10, 11, 12, 13, 14, 15, 16, 17, 18:
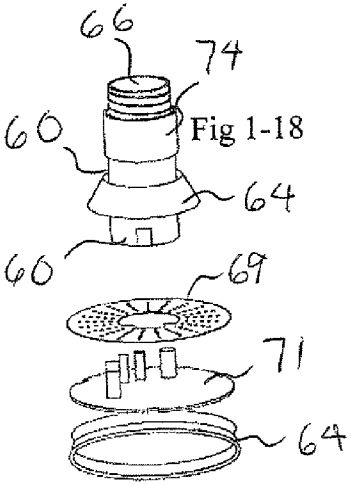
Figures 1, 2, 3, 4, 5, 6, 7, 8, 9, 10, 11, 12, 13, 14, 15, 16, 17, 18, 19:
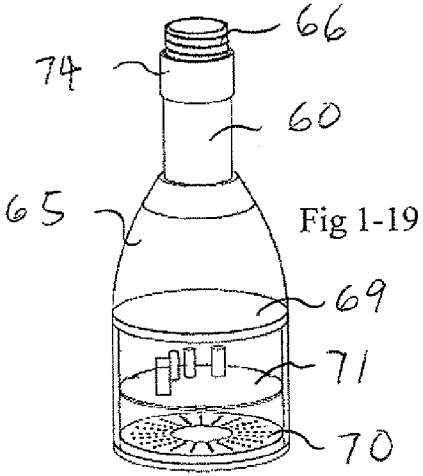
Figures 1, 2, 3, 4, 5, 6, 7, 8, 9, 10, 11, 12, 13, 14, 15, 16, 17, 18, 19, 20:
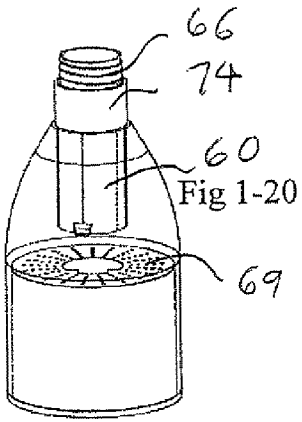
Figures 1, 2, 3, 4, 5, 6, 7, 8, 9, 10, 11, 12, 13, 14, 15, 16, 17, 18, 19, 20, 21:
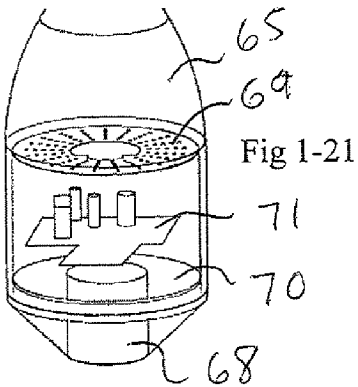
Figures 1, 2, 3, 4, 5, 6, 7, 8, 9, 10, 11, 12, 13, 14, 15, 16, 17, 18, 19, 20, 21, 22:
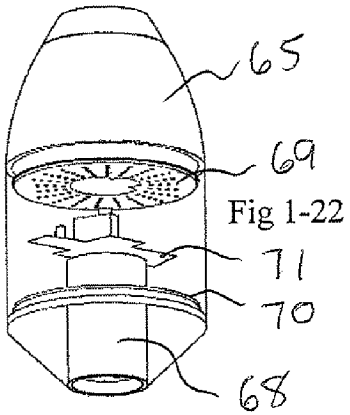
Figures 1, 2:
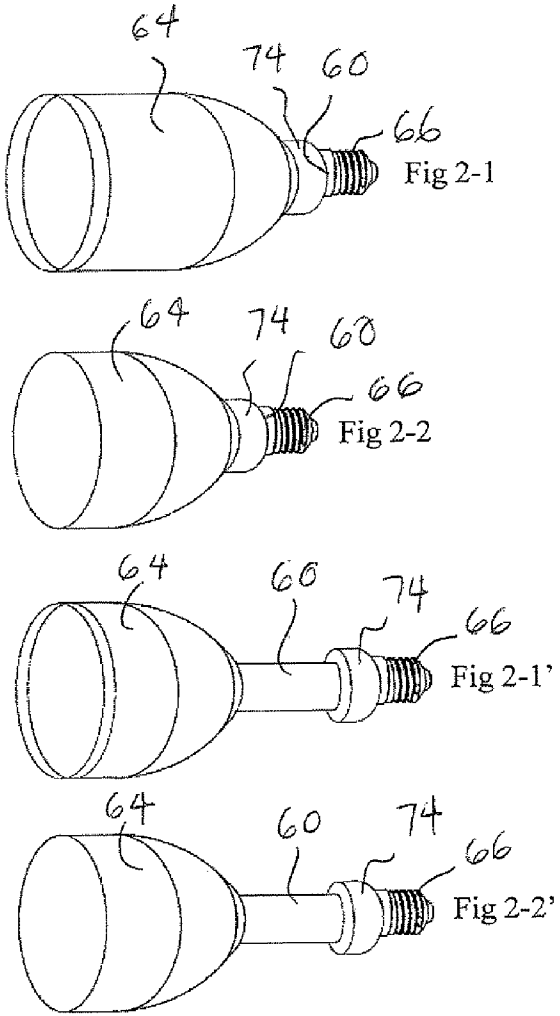
FIGS. 1-1, 1-2, and 1-3 shows a first group of embodiments in which an extendable piece(s) are provided in an LED bulb, lamp holder, and lamp holder adaptor.
Figures 3A, 3B, 3C, 4A, 4B, 4C:
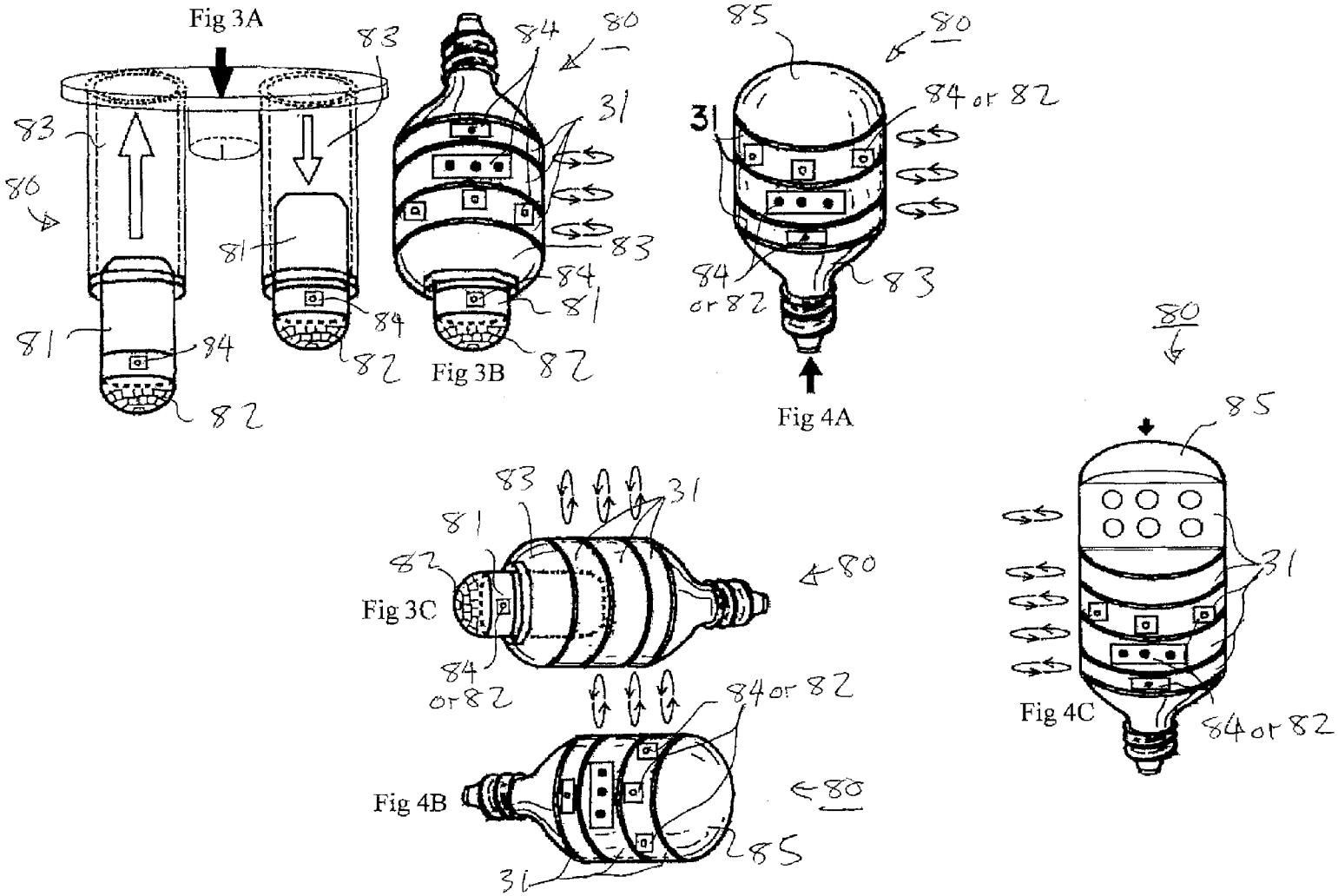
FIGS. 3A, 3B, 3C, 3D, 4A, 4B, 4C, 5A, 5B, 5C, and 5D are taken from above-listed copending application of the inventor and show LED bulbs with front extendable piece(s) arranged to install sensor heads, switch means, photo sensor, RF receiver(s), BLUETOOTH® receiver(s), timer receiver means, countdown means, seven-day programmable timer means, and other sensor or switch means available from market-available parts.
Figure 3D:
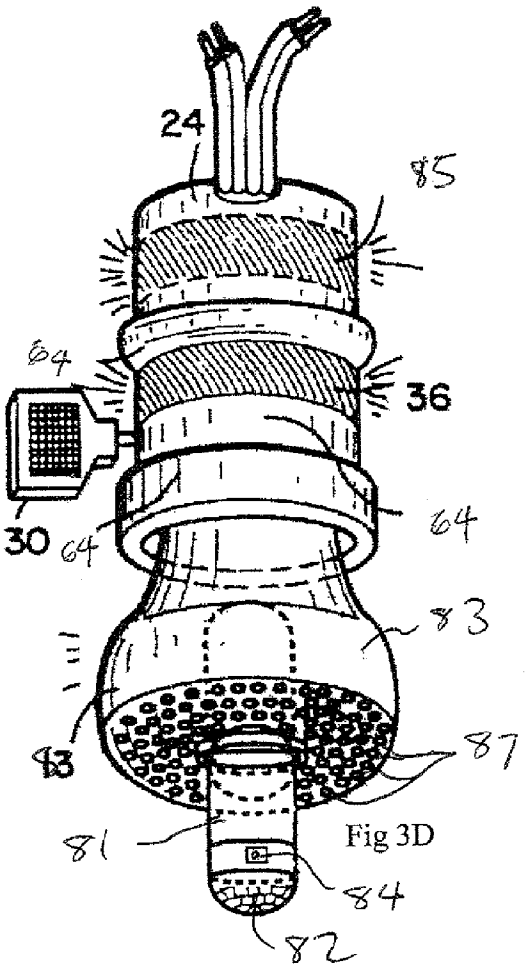
Figure 3E:
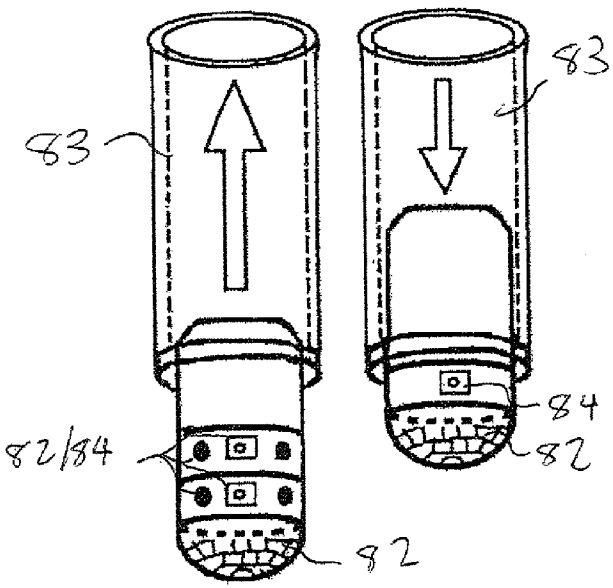

FIGS. 1-1, 1-2, and 1-3 respectively show a first group of embodiments having extendable piece(s) 60 with optional stoppers 74, the embodiments including an LED bulb 61, lamp holder 62, and lamp holder adaptor 63. As illustrated in FIGS. 1-1 to 1-3, the respective bodies 64 of the LED bulb 61, lamp holder 62, and lamp holder adaptor 63 may include at least one glow area 65, and conventional means such as a screw, bayonet, or pin type base 66 for plugging the bulb, lamp holder, or adaptor into a socket. As shown in FIG. 1-2, the adaptor may include adaptor means 68 to receive the base of another bulb, lamp holder, or adaptor and/or, as shown in FIG. 1-3, may include a 360 degree IR motion sensor.

FIGS. 1-4 to 1-22 show details of LED bulbs, lamp holders, and lamp holder adaptors that may be applied to the preferred embodiments of FIGS. 1-1 to 1-3. For example, FIG. 1-4 shows an LED bulb construction 61 with two LED assemblies 69,70 and a circuit board 71 therebetween, a housing part, and the extendable construction 62 extending from the above-mentioned screw, bayonet, or pin type plug means 66 for connection to a socket. FIGS. 1-5 to 1-7 show similar extendable constructions, with FIG. 1-7 specifically showing added function means 72 in the form of (1) a motion sensor; (2) an RF remote control; (3) a BLUETOOTH® remote control; (4) a timer; (5) a countdown timer; (6) a seven-day programmed timer; (7) an LED on/off control; and (8) digital data recording or storage. Other features include optional optics means 73 as shown in FIG. 1-5, and stoppers 74 as shown in FIGS. 1-5 to 1-7. FIGS. 1-8 to 1-22 show features corresponding to FIGS. 1-5 to 1-18 that also may be applied to an LED bulb, lamp holder, or lamp holder adaptor of the type shown in FIGS. 1-1 to 1-3.

FIGS. 2-1 and 2-2 show unextended LED bulbs, lamp holders, or adaptors corresponding to those of FIGS. 1-1 to 1-3. FIGS. 2-1' and 2-2' show the same LED bulbs, lamp holders, or adaptors of respective FIGS. 2-1 and 2-2, but in which the extendable pieces have been extended to illustrate the resulting length difference.

Figures 5A, 5B, 5C, 5D:
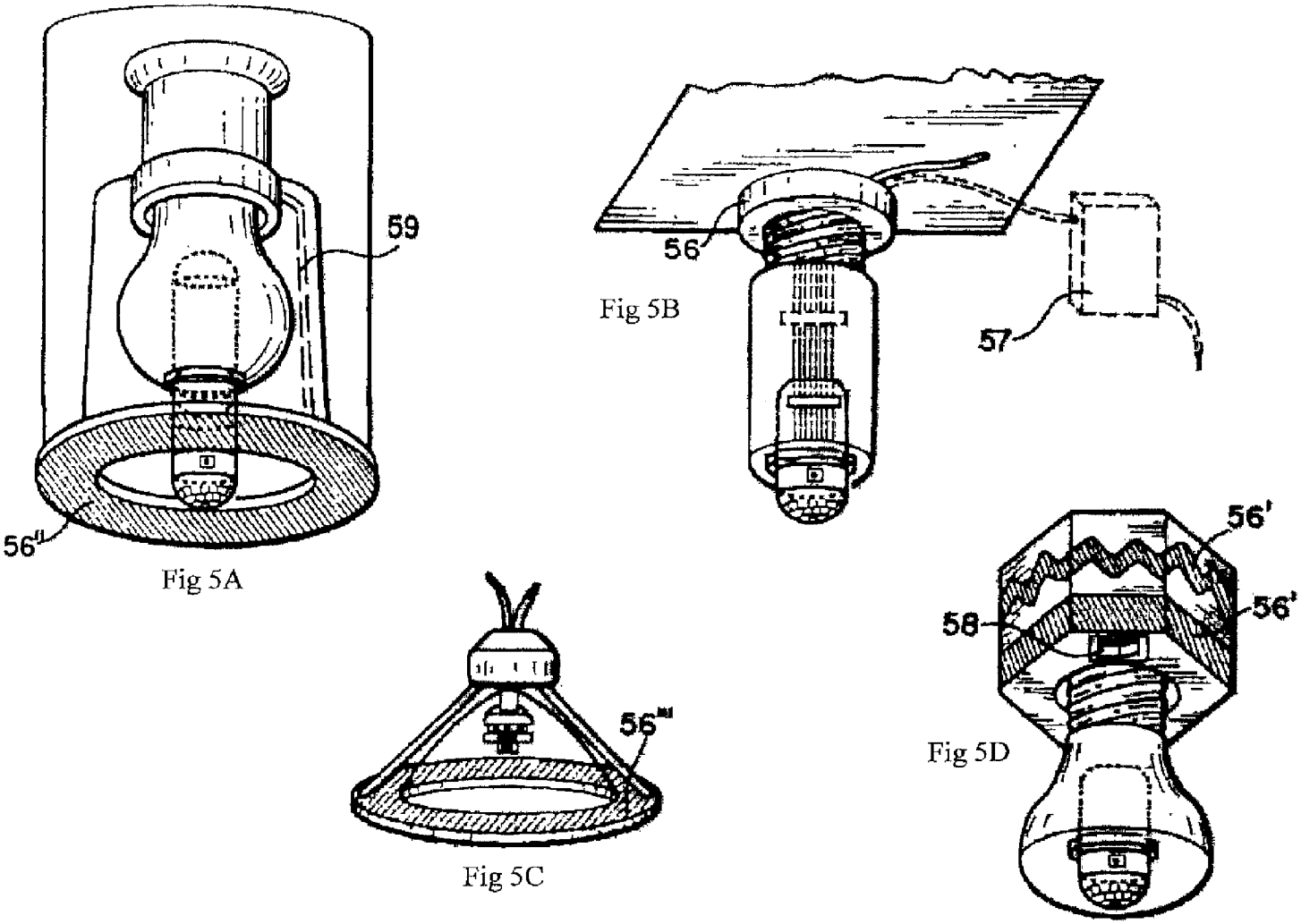

FIGS. 3A, 3B, 3C, 3D, 4A, 4B, 4C, 5A, 5B, 5C, and 5D show an LED bulb 80 with front extendable piece(s) 81 and glow areas 85 or LED arrays 87 corresponding to the LED bulb disclosed in the above-cited inventor's copending parent U.S. patent application Ser. Nos. 13/295,301, 13/296,469, and Ser. No. 12/296,508 to install sensor heads, switch means, photo sensor, RF receiver(s), BLUETOOTH® receiver(s), timer receiver means, countdown means, seven-day programmable timer means, and other sensor or switch means available from market available parts. As shown in FIGS. 3A-3C and 4A-4C, the sensors and/or a camera 82 or 84 can be extended or retracted and rotated to avoid interference by lamp shades, lamp covers, lamp walls, or other blocking means 83 that otherwise might block a field of view of the camera or sensor. The device may have multiple rings 31, each of which is separately rotatable to enable separate rotation of the sensor(s) and difference camera heads, as shown in FIGS. 3A-3C and 4A-4C. As shown in FIG. 3D and FIGS. 5A-5D, the extension may enable the position, orientation, or angle of the sensor or camera head to be varied, or enable the sensor to be extended while the lighting feature is within a shade, and the device may further include external light elements such as lighting elements 85 and 36, as well as additional sensors such as sensor 30, all shown in FIG. 3D, and lighting elements 56', 56", and 56''' shown in FIGS. 5A, 5C, and 5D. FIG. 5B also shows an external circuit means for providing additional control functions and a base 56 through which power is supplied to the bulb.

Figure 6B:
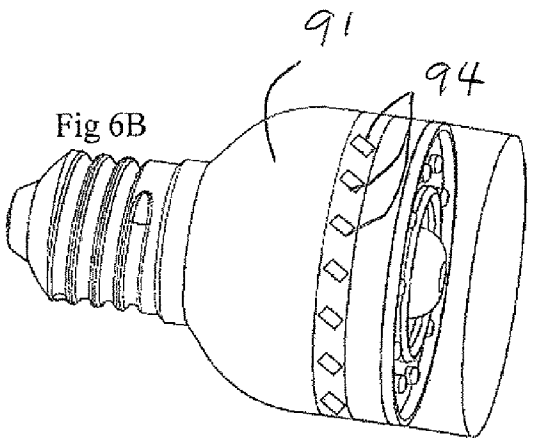
FIGS. 6A, 6B, 6C, 6D are taken from above-listed copending applications of the inventor and show comparisons of LED bulbs with front extendable piece(s) and LED bulb without front extendable piece(s) that cannot overcome the blocking mean(s).
Figure 6D:
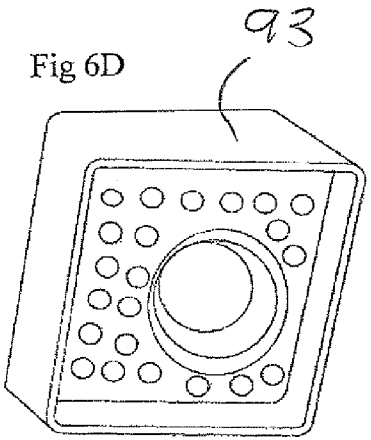
Figure 6A:
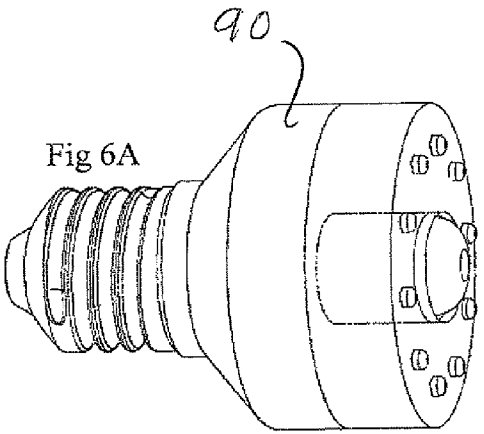
Figure 6C:
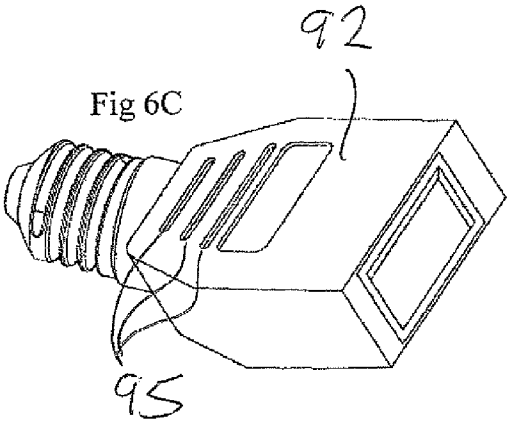

FIGS. 6A, 6B, 6C, 6D show alternative LED bulbs 90, 91, 92, and 93, including high power LED bulbs 91 and 93 with ventilation openings 94 and 95 as shown in FIGS. 6A and 6B, as also disclosed in copending parent U.S. patent application Ser. No. 13/296,469.

As shown in the drawings, the LED light device of the preferred embodiments may include one extendable construction to allow sensor means or switch means or light means to overcome blocking means in the form of a lamp cover, lamp shade, lamp glass, or light fixture that would otherwise block light or electrical signal transmission from the extendable construction. The blocking means may further include a stencil, opening, cover, decorative means, lens, or other objects which have equivalent function of the blocking means in interfering with light beam or electric signal transmission.

The LED light device of the preferred embodiments may incorporate any desired group or combination of selected parts and accessories to cause areas of the bulb, holder or adaptor body to glow, and may further include:

(a) plug parts to connect with a power source through a socket, the plug parts being in the form of a standard screw plug or one that tolerates a degree of twisting to adjust the orientation, direction, or position of the bulb, holder, or adaptor, or any other type of plug parts including a pin-plug, position-and-twist plug, or other market available type of plug parts;

(b) multiple parts for multiple illumination areas;

(c) extendable pieces of different geometric shape and size;

(d) stopper means having a desired geometric shape and size to stop the extendable piece(s) from extending too far;

(e) energy storage means for DC energy such as rechargeable or regular batteries;

(f) LED-unit(s) and LED-assembly(s) with desired brightness, size, and shape;

(g) circuit means for a variety of desired functions;

(h) conductive means and related parts and accessories for delivering an electric signal;

(i) construction parts for fitting related mechanical or electric parts and accessories within the bulb, lamp holder, or adaptor;

(j) motion sensor means;

(k) remote control means;

(l) BLUETOOTH® remote control means;

(m) timer means;

(n) count down means;

(o) seven-day programmable timer means;

(p) other switch means or sensor means;

(q) integrated circuit (IC) means;

(r) digital data record and storage means;

(s) optics means including all kinds of lens, stencil, windows, opening, cut-outs, reflective lens, retro-reflective lens, opaque lens, condensing lens, convex lens, concave lens, or adjustable focus lens, or any other optics means that may be applied to an LED light means;

(t) a heat sink to ventilate heat from LEDs out of the light unit;

(u) receiving parts and accessories for a lamp holder or lamp holder adaptor including a screw base, bayonet base, pin-base, or position-and-twist base;

(v) transparent, translucent, opaque, and/or anti-flammable body parts;

(w) heat isolating means;

(x) light blocking means;

(y) switch means or sensor means available from the marketplace;

(z) linkable means to link multiple LED lights or lamp holders for illumination at the same time.

The LED light device with extendable construction and added functions, may take the form of a desk lamp, table lamp, reading lamp, mirror lamp, floor lamp, wall lamp, outdoor lamp, indoor lamp, ceiling lamp, chandelier lamp, track lighting, garden lamp, seasonal lamp, or other lamps available from the marketplace.

Those skilled in the art will appreciate that the extendable construction may be on at least one end, both ends, or any desired surface(s) of the LED bulb, lamp holder, or lamp holder adaptor.

The related parts and accessories for the added functions, including circuitry, electric parts, and accessories may be arranged to fit within the a compartment(s) in the device or in the extendable construction space.

The LED light device of the invention may include a single side, double side, or multiple layer printed circuit board with LED(s) having a desired shape, specifications, brightness, luminance, power consumption, color, color K-temperature, viewing angle, and/or size to meet market requirement(s).

The plug parts of the LED bulb, lamp holder, or lamp holder adaptor may have an extra tolerance with respect to twisting so as to allow the LED bulb, lamp holder, or adaptor to be moved to a position in which the sensor means and/or switch means are aimed at a desired location, orientation, or direction to receive electric signals.

Finally, the extendable construction may be fixed at different lengths by incorporating appropriate stopper means or lock means to stop or lock the extendable construction at a desired extended length.

It will appreciated that the current invention should not be limited by the current drawings, detailed description, and that modifications and variations may still fall within the scope of the current invention.

The invention claimed is:

1. An LED light device, comprising:

a light device body and means for electrically connecting the LED light device to a power source upon insertion of the LED light device into a light socket;

an extendable module arranged to extend from and to be retracted into said light device body, wherein said extendable module includes circuitry and an electronic unit for wireless electromagnetic communication comprising at least one of a sensor, a remote control, an integrated circuit, and a digital data recording and storage device;

at least one LED arranged in the light device body outside said extendable module;

a blocking means included in said light device body that interferes with transmission and reception of wireless electromagnetic signals to and from said electronic unit when said extendable module is retracted into the light device body, thus interfering with operation of the electronic unit;

wherein when said extendable module is extended from said light device body, said blocking means no longer interferes with transmission and reception of wireless electromagnetic signals to and from said electronic unit, thus allowing operation of the electronic unit without interference by the blocking means;

wherein said blocking means is one of a lamp cover, lamp shade, lamp glass, and light fixture; and wherein the LED light device is an LED bulb.

2. An LED light device as claimed in claim 1, wherein said means for electrically connecting include at least one of a screw plug, a pin plug, and a position-and-twist plug.

3. An LED light device as claimed in claim 1, further comprising stopper means for stopping extension of said extendable module from the light device body.

4. An LED light device as claimed in claim 1, further comprising a heat sink for conducting heat to an outside of the light device body.

5. An LED light device as claimed in claim 1, wherein the LED light device further comprises optics means for modifying light from said at least one LED, said optics means including at least one of a concave, convex, or condensing lens, stencil, window, opening, cut-out, reflector, retro-reflector, and adjustable focus mechanism.

6. An LED light device as claimed in claim 1, wherein the LED light device is included in at least one of a desk lamp, table lamp, reading lamp, mirror lamp, floor lamp, wall lamp, outdoor lamp, indoor lamp, ceiling lamp, chandelier lamp, track lighting, garden lamp, and seasonal lamp.

7. An LED light device as claimed in claim 1, wherein the extendable module extends from one end, both ends, or at least one surface of the LED bulb, lamp holder, or lamp holder adaptor.

8. An LED light device as claimed in claim 1, wherein said circuitry and additional electric parts and accessories are fitted within compartments in said extendable module.

9. An LED light device as claimed in claim 1, wherein said light device body includes a circuit board on which said at least one LED is mounted.

10. An LED light device as claimed in claim 1, wherein said means for electrically connecting include means for enabling twisting of the extendable module to a selected orientation when the LED light device is plugged into a socket, thereby enabling the electronic unit in the extendable module to be aimed in a desired direction.

11. An LED light device as claimed in claim 1, further comprising lock means to lock the extendable module at least one predetermined extension position.

* * * * *